US010264837B2

(12) United States Patent
Park

(10) Patent No.: US 10,264,837 B2
(45) Date of Patent: Apr. 23, 2019

(54) FALSE EYELASH ORGANIZER

(71) Applicant: Chan Gyu Park, Bucheon (KR)

(72) Inventor: Chan Gyu Park, Bucheon (KR)

( * ) Notice: Subject to any disclaimer, the term of this patent is extended or adjusted under 35 U.S.C. 154(b) by 536 days.

(21) Appl. No.: 14/948,298

(22) Filed: Nov. 21, 2015

(65) Prior Publication Data

US 2017/0112264 A1 Apr. 27, 2017

(30) Foreign Application Priority Data

Oct. 23, 2015 (KR) ..... 20-2015-0006906 U

(51) Int. Cl.

| | |
|---|---|
| ***A41G 5/02*** | (2006.01) |
| ***A45C 11/24*** | (2006.01) |
| ***A45C 13/02*** | (2006.01) |
| ***A45D 44/00*** | (2006.01) |

(52) U.S. Cl.

CPC ..... *A41G 5/02* (2013.01); *A45C 11/24* (2013.01); *A45C 13/02* (2013.01); *A45D 44/00* (2013.01)

(58) Field of Classification Search

CPC ..... A41G 5/02
USPC ..... 132/216, 53
See application file for complete search history.

(56) References Cited

U.S. PATENT DOCUMENTS

| | | | | |
|---|---|---|---|---|
| 2013/0160783 | A1* | 6/2013 | Ahn | A41G 5/02 132/53 |
| 2013/0160787 | A1* | 6/2013 | Chae | A41G 5/02 132/201 |
| 2015/0216246 | A1* | 8/2015 | Ahn | A41G 5/02 132/53 |
| 2016/0037848 | A1* | 2/2016 | Lee | A41G 5/02 132/201 |
| 2016/0324241 | A2* | 11/2016 | Lee | A41G 5/02 |

FOREIGN PATENT DOCUMENTS

KR 20-0219762 4/2001

OTHER PUBLICATIONS

English translation of 20-0219762.

* cited by examiner

*Primary Examiner* — Tatiana L Nobrega
(74) *Attorney, Agent, or Firm* — Novick, Kim & Lee, PLLC; Sang Ho Lee

(57) ABSTRACT

According to an embodiment of the present disclosure, an eyelash organizer includes a first body portion, a supporting portion formed on the first body portion, at least one fixing portion positioned on the first body portion, at least one false eyelash fastened to the at least one fixing portion, and a second body portion positioned opposite the first body portion. The supporting portion is bent or curved from the second body portion to allow the at least one fixing portion to be spaced apart from the second body portion, leaving a space between the at least one fixing portion and the second body portion.

3 Claims, 10 Drawing Sheets

FALSE EYELASH ORGANIZER

CROSS-REFERENCE TO RELATED APPLICATIONS

This patent application claims priority under 35 U.S.C. § 119 to Korean Patent Application No. 20-2015-0006906, filed on Oct. 23, 2015, in the Korean Intellectual Property Office, the disclosure of which is incorporated by reference herein in its entirety.

TECHNICAL FIELD

Embodiments of the present disclosure concern the storage of false eyelashes, and more specifically, to false eyelash organizers that may be bent at a predetermined angle to allow the user to easily pull out false eyelashes therefrom.

DISCUSSION OF RELATED ART

Eyelash extensions or false eyelashes are used to enhance the length, thickness, or fullness to natural eyelashes. The extensions or false eyelashes may consist of silk, mink, or synthetic hair. Various types of containers or false eyelash organizers come in use to store false eyelashes. Such conventional-type storage containers, however, are inconvenient to use or may sometimes cause damage when holding or pulling out the false eyelashes.

Thus, a need exists for a type of false eyelash organizer that enables easier removal without harming the false eyelashes.

SUMMARY

According to an embodiment of the present disclosure, an eyelash organizer comprises a first body portion where a first end of at least one false eyelash is fastened and a second body portion positioned opposite the first body portion. The first body portion may be bent or curved from the second body portion to allow a second end of the at least one false eyelash to be spaced apart from the organizer.

The first body portion may include at least one fixing portion formed thereon. The at least one false eyelash may be fastened to the at least one fixing portion of the first body portion.

The at least one fixing portion may be detachably inserted into at least one hole formed in the organizer.

The first body portion may be detachably coupled to the second body portion along a line where the at least one fixing portion abuts the second body portion.

According to an embodiment of the present disclosure, an eyelash organizer comprises a first body portion, a supporting portion formed on the first body portion, at least one fixing portion positioned on the first body portion, at least one false eyelash fastened to the at least one fixing portion, and a second body portion positioned opposite the first body portion. The supporting portion may be bent or curved from the second body portion to allow the at least one fixing portion to be spaced apart from the second body portion and to leave a space between the at least one fixing portion and the second body portion.

The at least one fixing portion may include a first fixing portion and a second fixing portion. The first fixing portion and the second fixing portion may abut or be spaced apart from each other on the same surface of the supporting portion. Alternatively, the first fixing portion and the second fixing portion, respectively, may be formed on different surfaces of the supporting portion.

The eyelash organizer may further comprise a protecting portion formed on the second body portion to protect the at least one false eyelash. The protecting portion has a protecting surface. The protecting surface may be formed to be inclined to prevent the at least one false eyelash from contacting the protecting portion. The eyelash organizer may further include a plurality of side supporting portions integrally or separately formed with each other along an edge of the organizer and extending in at least one of a first direction along which the supporting portion projects or a second direction opposite the first direction. As the supporting portion is bent or curved from the second body portion of the eyelash organizer, the plurality of side supporting portions may be bent inward or outward to allow the supporting portion to be easily bent or curved.

A plurality of holes may be formed along a line where the supporting portion and the at least one fixing portion abut the second body portion and which extends to the plurality of side supporting portions to allow the supporting portion and the at least one fixing portion to be separated from the organizer along the line.

According to an embodiment of the present disclosure, an eyelash organizer comprises a first body portion, a mounting portion, and a folding portion. The first body portion may include a plurality of insertion holes where a first end of at least one false eyelash is inserted and a separating portion projecting between two adjacent insertion holes of the plurality of insertion holes. A second end of the at least one false eyelash may be placed on the mounting portion to protect the at least one false eyelash. The folding portion may be formed between the first body portion and the mounting portion to facilitate to bend or curve the first body portion from the mounting portion. The first body portion may be bent or curved from the mounting portion with respect to the folding portion to form a space between the first body portion and the mounting portion.

The eyelash organizer may further comprise a plurality of flexible side supporting portions integrally or separately formed with each other along an edge of the organizer and extending in at least one of a first direction along which the separating portion projects or a second direction opposite the first direction. As the separating portion is bent or curved from the mounting portion of the eyelash organizer, the plurality of side supporting portions may be bent inward or outward of, e.g., the organizer, to allow the separating portion to be easily bent or curved.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein.

DETAILED DESCRIPTION OF EXEMPLARY EMBODIMENTS

Hereinafter, exemplary embodiments of the inventive concept will be described in detail with reference to the accompanying drawings. Like reference denotations may be used to refer to the same or substantially the same elements throughout the specification and the drawings. The inventive concept, however, may be modified in various different ways, and should not be construed as limited to the embodiments set forth herein. As used herein, the singular forms "a," "an," and "the" are intended to include the plural forms as well, unless the context clearly indicates otherwise. It will be understood that when an element or layer is referred to as being "on," "connected to," "coupled to," or "adjacent to" another element or layer, it can be directly on, connected, coupled, or adjacent to the other element or layer, or intervening elements or layers may be present.

According to in embodiment of the present disclosure, an eyelash organizer (simply referred herein to as an eyelash organizer or an organizer) includes a first both portion where a first end of at least one false eyelash is fastened and a second body portion positioned opposite the first body portion. The first body portion may be bent and inclined from the second body portion to allow a second end of the at least one false eyelash to be spaced apart from the organizer, thereby allowing the user to easily take the false eyelash out of the organizer.

Figure 1:
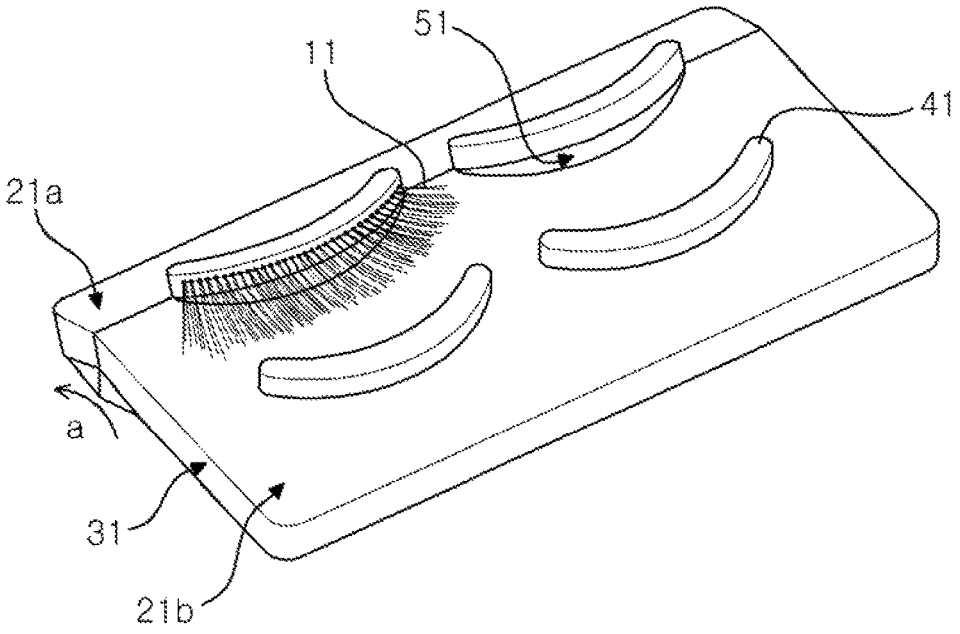
FIG. 1 is a view illustrating a false eyelash organizer according to an embodiment of the present disclosure.

FIG. 1 is a view illustrating a false eyelash organizer according to an embodiment of the present disclosure.

Referring to FIG. 1, the false eyelash organizer includes a first body portion 21*a* and a second body portion 21*b*. The first body portion 21*a* and the second body portion 21*b* may be bent with respect to each other at a predetermined angle in a direction a as shown in FIG. 1. One or more fixing portions 41 may be formed on the first body portion 21*a* of the organizer. At least one or more false eyelashes 11 may be fastened or fixed to the first body portion 21*a*. As the first body portion 21*a* of the organizer is bent or curved in the direction a from the second body portion 21*b*, the fixing portions 41 may be inclined and spaced apart from the organizer (e.g., the second body portion 21*b* of the organizer) to form spaces 51 between the fixing portions 41 and the organizer (e.g., the second body portion 21*b* of the organizer).

As such, as the first body portion 21*a* including the fixing portions 41 is bent from the second body portion 21*b*, the ends of the fixing portions 41 where the false eyelashes 11 are attached are lifted up from the second body portion 21*b*, allowing the user to easily take the false eyelashes 11 out of the fixing portions 41. A side supporting portion 31 may be formed on a side of the organizer.

Figure 2:
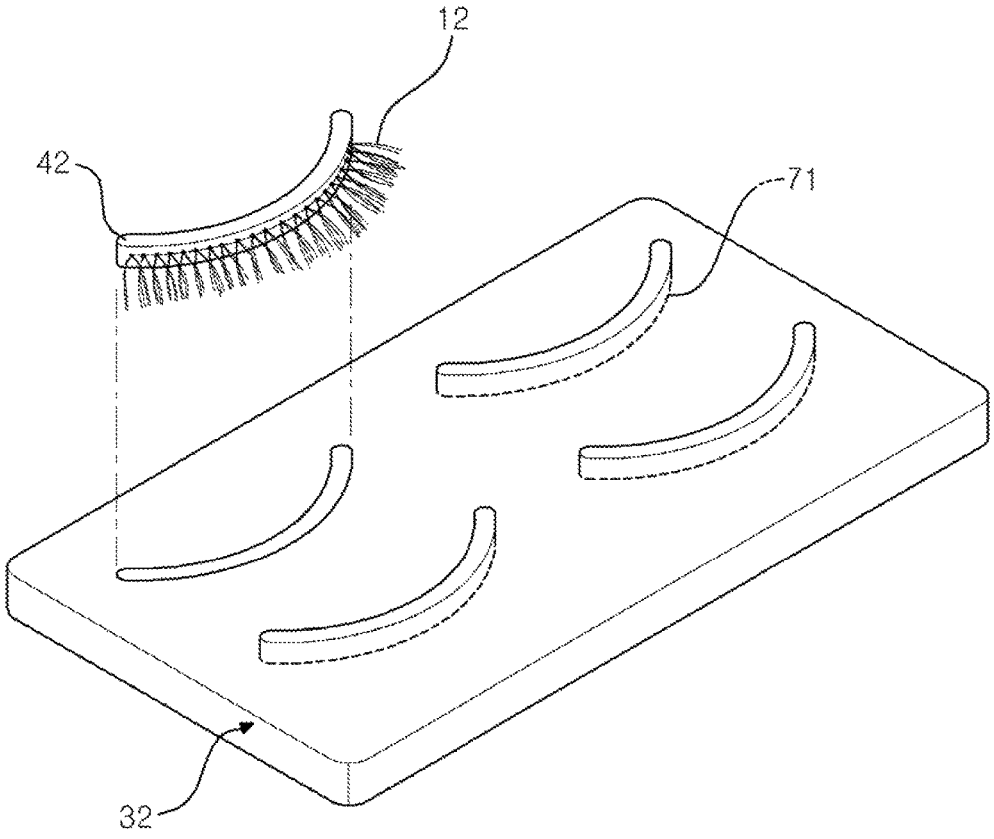
FIG. 2 is a view illustrating a false eyelash organizer having a hole according to an embodiment of the present disclosure.
Figure 3:
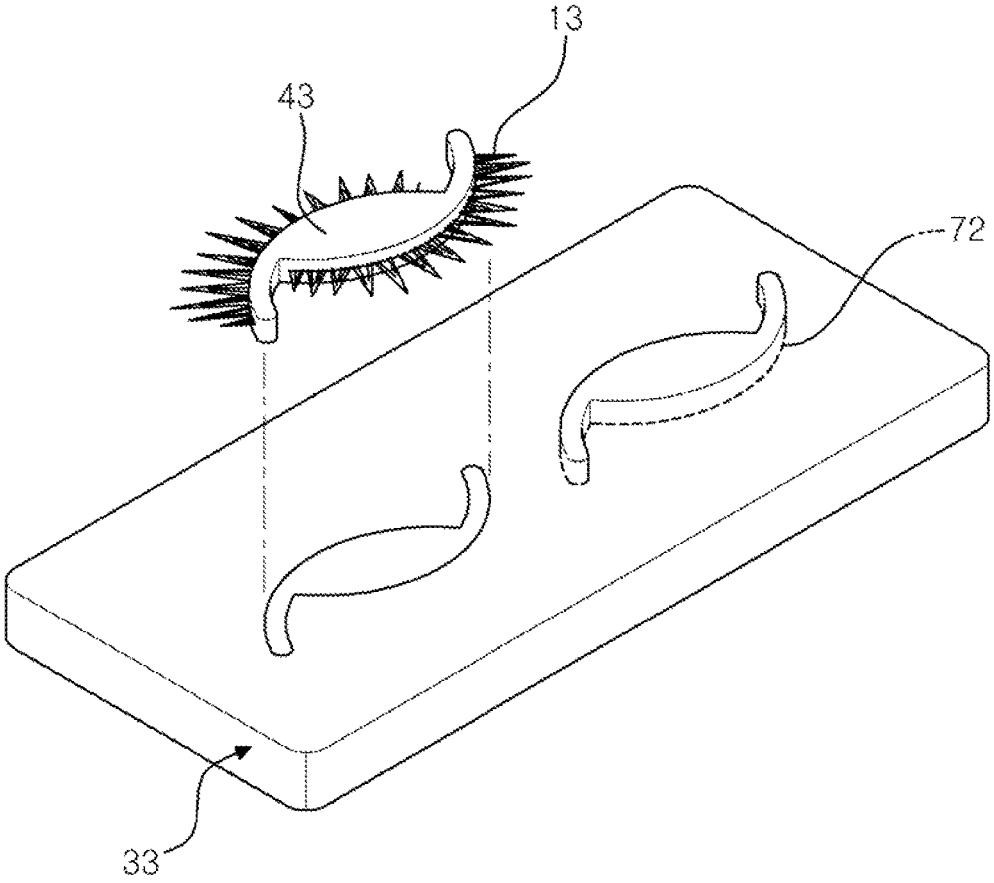
FIG. 3 is a view illustrating a false eyelash organizer having a hole according to an embodiment of the present disclosure.

FIG. 2 is as view illustrating a false eyelash organizer having a hole according to an embodiment of the present disclosure. FIG. 3 is a view illustrating a false eyelash organizer having a hole according to an embodiment of the present disclosure.

Referring to FIGS. 2 and 3, a plurality of holes 71 and 72 may be formed in the organizer (e.g., the top of the organizer) in shapes respectively corresponding to the fixing portions 42 and 43. False eyelashes 12 and 13, respectively, may be attached to the fixing portions 42 and 43. Accordingly, the fixing portions 42 and 43, respectively, may be detachably inserted into the holes 71 and 72. A side supporting portion 32 may be formed on as side of the organizer as shown in FIG. 2, and a side supporting portion 33 may be formed on a side of the organizer as shown in FIG. 3.

Figure 11:
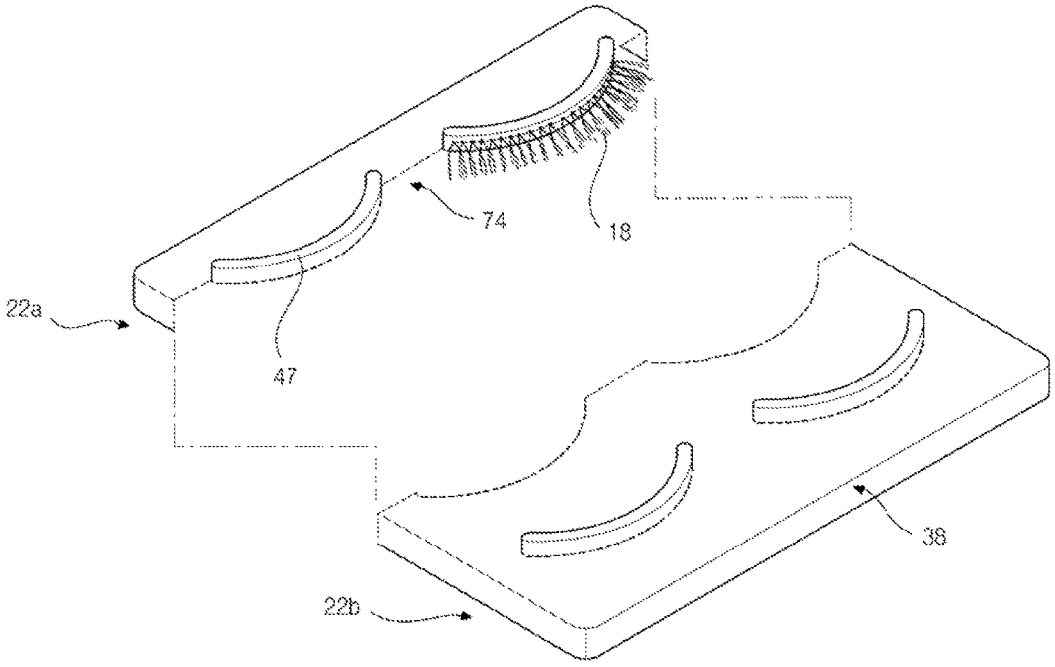
FIG. 11 is a view illustrating a false eyelash organizer having a hole according to an embodiment of the present disclosure.

FIG. 11 is a view illustrating a false eyelash organizer having a hole according to an embodiment of the present disclosure.

The organizer may include a first body portion 22*a* and a second body portion 22*b*. The first body portion 22*a* of the organizer may include one or more fixing portions 47. False eyelashes 18 may be attached to the fixing portions 47. A plurality of holes 74 may be formed along a line where the fixing portions 47 abut the second body portion 22*b*. The first body portion 22*a* of the organizer may be coupled or separated from the second body portion 22*b* of the organizer along the line. A side supporting portion 38 may be formed on a side of the organizer.

Figure 5:
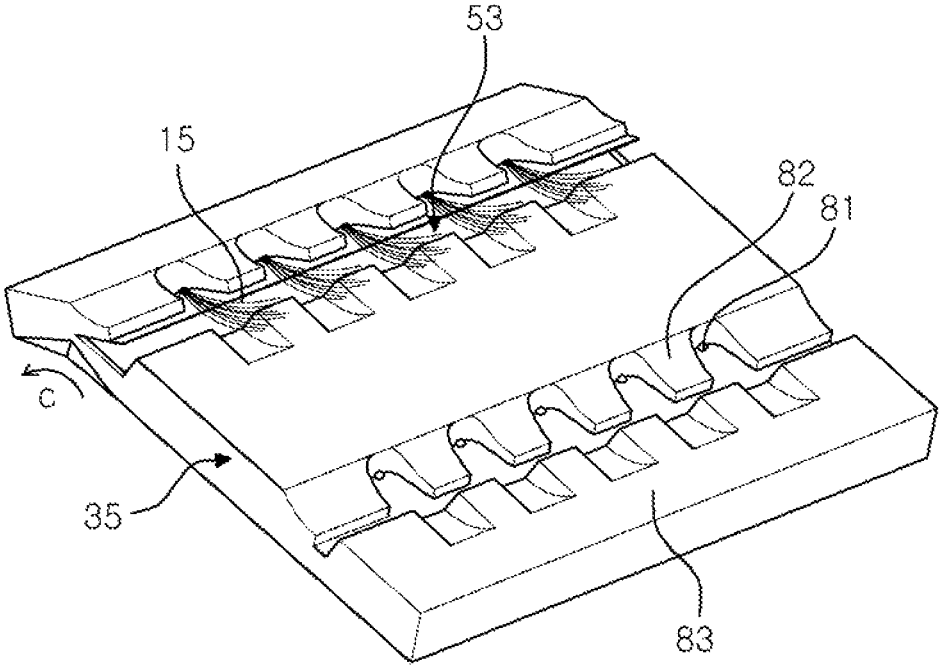
FIG. 5 is a view illustrating a false eyelash organizer according to an embodiment of the present disclosure.

FIG. 5 is a view illustrating a false eyelash organizer according to an embodiment of the present disclosure.

Referring to FIG. 5, the organizer includes a first body portion, a mounting portion 83, and a folding portion. The first body portion may include a plurality of insertion holes 81 where first ends of false eyelashes 15 are inserted and separating portions 82 projecting between two adjacent ones of the plurality of insertion holes 81. Second ends of the false eyelashes 15 are placed on the mounting portion 83, and thus, the false eyelashes may be protected.

The folding portion may be formed between the first body portion and the mounting portion 83. For example, the folding portion may connect the first body portion with the mounting portion 83. The folding portion may facilitate to bend or curve the first body portion from the mounting portion 83. The first body portion may be bent or curved from the mounting portion 83 with respect to the folding portion in a direction c to form a space 53 between the first body portion and the mounting portion 83.

As such, as the first body portion of the organizer is bent at the folding portion in the direction c, the second ends of the false eyelashes 15 are lifted up from the mounting portion 83, so that the user may easily detach the false eyelashes 15 from the organizer.

The organizer may further include a plurality of side supporting portions 35 integrally or separately formed with each other along an edge of the organizer and extending in at least one of a first direction along which the separating portions 82 project or a second direction opposite the first direction. The side supporting portions 35 may support the organizer.

The side supporting portions 35 may be flexibly bent or folded. For example, the side supporting portions 35 may be formed of a flexible material. As the first body portion including the separating portions 82 is bent or curved, the side supporting portions 35 may be bent or folded inward or outward to allow the supporting portion to be easily bent or curved.

Figure 4:
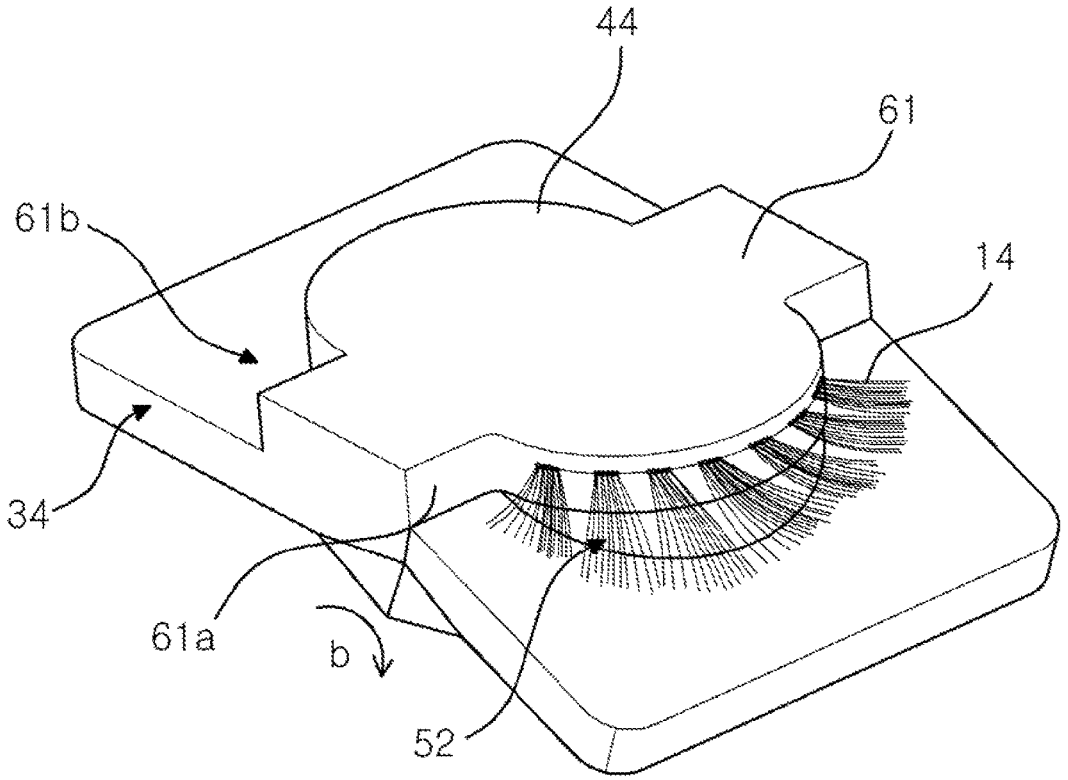
FIG. 4 is a view illustrating a false eyelash organizer according to an embodiment of the present disclosure.

FIG. 4 is a view illustrating a false eyelash organizer according to an embodiment of the present disclosure.

Referring to FIG. 4, the organizer may include a first body portion and a second body portion. The organizer may include a supporting portion 61 and fixing portions 44. The supporting portion 61 may be formed on the first body portion of the organizer. For example, the supporting portion 61 may be integrally formed with the first body portion of the organizer. For example, the fixing portions 44 may be integrally formed with the supporting portion 61.

The fixing portions 44, respectively, may project from side surfaces 61*a* and 61*b* of the supporting portion 61. At least one false eyelashes 14 may be fastened to each fixing portion 44.

The second body portion of the organizer may be bent from the first body portion of the organizer at a predetermined angle in a direction b, thereby boning a space 52 between the fixing portion 44 and the second body portion of the organizer. A side supporting portion 34 may be formed on a side of the organizer.

Figure 6:
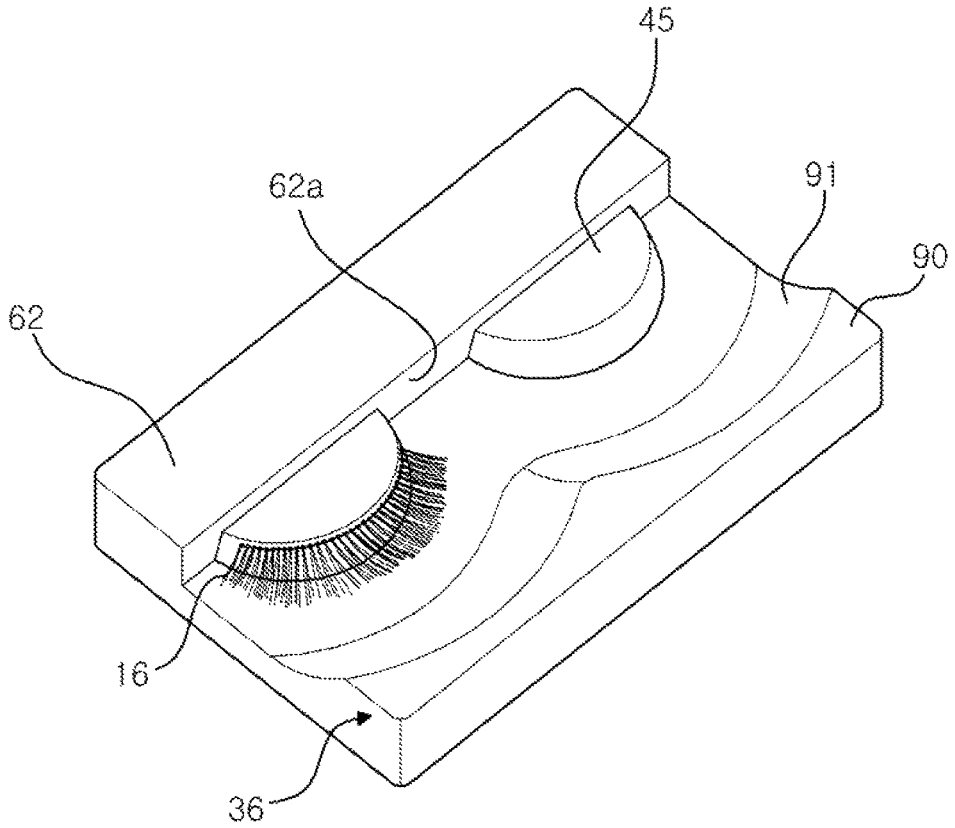
FIG. 6 is a view illustrating a false eyelash organizer according to an embodiment of the present disclosure.
Figure 7:
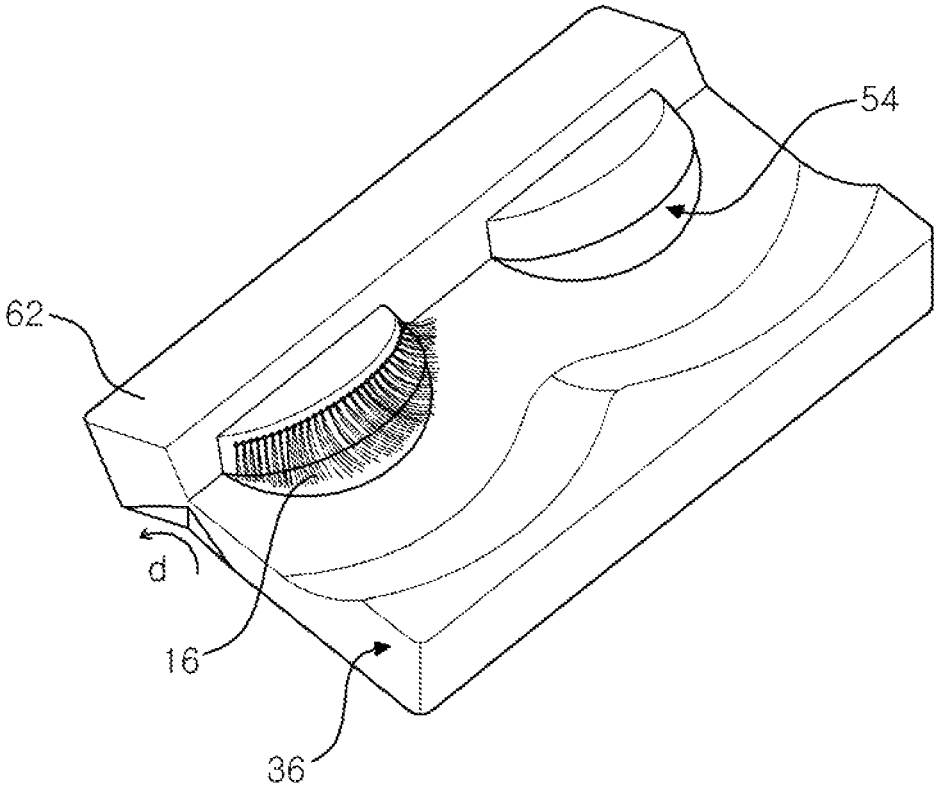
FIG. 7 is as view illustrating a false eyelash organizer with a support as shown in FIG. 6 bent or rotated, according to an embodiment of the present disclosure.
Figure 8:
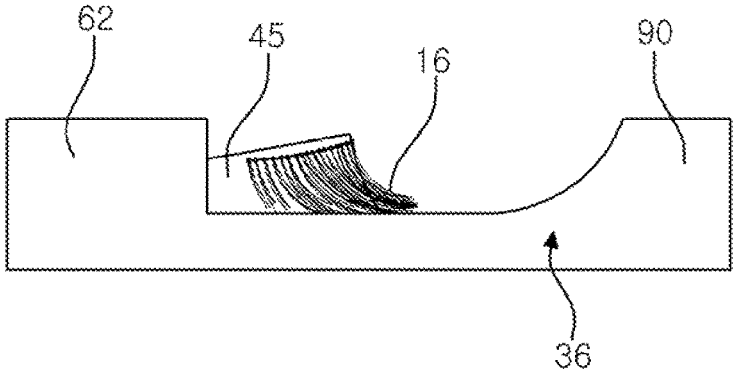
FIG. 8 is a side view illustrating the false eyelash organizer of FIG. 6, according to an embodiment of the present disclosure.
Figure 9:
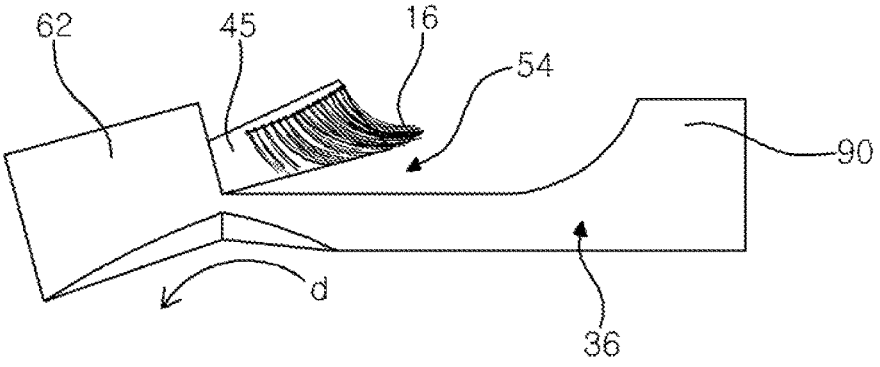
FIG. 9 is a side view illustrating the false eyelash organizer of FIG. 7, according to an embodiment of the present disclosure.

FIG. 6 is a view illustrating a false eyelash organizer according to an embodiment of the present disclosure. FIG. 7 is a view illustrating a false eyelash organizer with a support as shown in FIG. 6 bent or rotated, according to an embodiment of the present disclosure. FIG. 8 is a side view illustrating the false eyelash organizer of FIG. 6, according to an embodiment of the present disclosure. FIG. 9 is a side view illustrating the false eyelash organizer of FIG. 7, according to an embodiment of the present disclosure.

Referring to FIGS. 6 to 9, the organizer may include a first body portion, a second body portion, a protecting portion 90 having a protecting surface 91, a supporting potion 62, and a plurality of side supporting portions 36.

A plurality of fixing portions 45 may be formed to be spaced apart from each other at a predetermined distance on the same surface 62*a* of as supporting portion 62. Alternatively, the plurality of fixing portions 45 may be formed to abut each other on the same surface 62*a* of the supporting portion 62.

The protecting portion 91 may be formed on the second body portion of the organizer to protect a false eyelash 16. For example, the protecting surface 91 may be formed to be inclined to prevent the false eyelash 16 from contacting the protecting portion 90.

The side supporting portions 36 may be integrally or separately formed with each other along an edge of the organizer and may extend in at least one of a first direction along which the supporting portion 62 projects or a second direction opposite the first direction to support the organizer.

The side supporting portions 36 may be flexibly bent or folded. For example, the side supporting portions 36 may be formed of a flexible material. As the first body portion or the supporting portion 62 is bent or curved from the second body portion of the organizer in a direction d while forming spaces 54 between the fixing portions 45 and the organizer (e.g., the second body portion of the organizer), the side supporting portions 36 may be bent or folded inward or outward to allow the supporting portion to be easily bent or curved.

Figure 10:
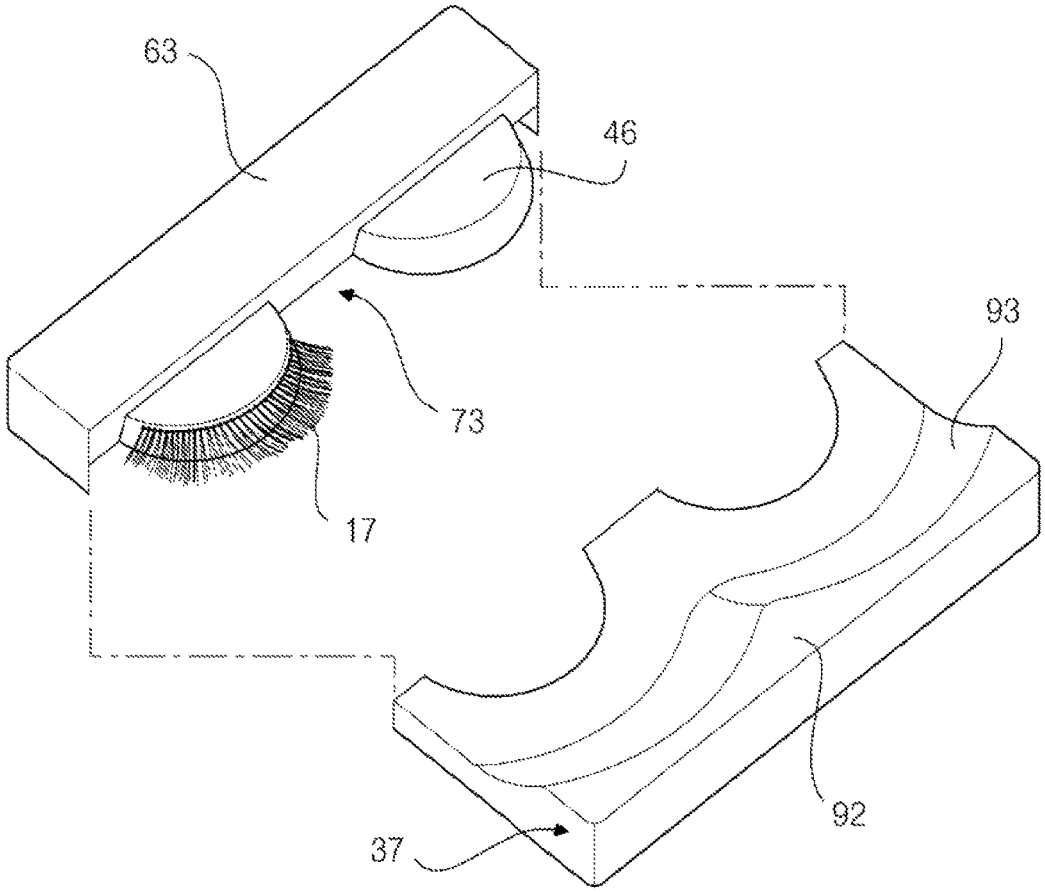
FIG. 10 is a view illustrating a false eyelash organizer having a hole according to an embodiment of the present disclosure.

FIG. 10 is a view illustrating a false eyelash organizer having a hole according to an embodiment of the present disclosure.

Referring to FIG. 10, the organizer may include a first body portion and a second body portion. The first body portion of the organizer may include a supporting portion 63, e.g., integrally formed therewith and one or more fixing portions 46 formed on the supporting portion 63. For example, the fixing portions 46 may be integrally formed with the supporting portion 63. False eyelashes 17 may be attached to the fixing portions 46. A plurality of holes 73 may be formed along a line where the fixing portions 46 abut the second body portion of the organizer. The first body portion of the organizer may be coupled or separated from the second body portion of the organizer alone the line via the holes 73. A side supporting portion 37 may be formed on a side of the organizer. A protecting portion 92 may be formed on the second body portion of the organizer. The protecting portion 92 may include a protecting surface 93 which is an inclined surface.

According to embodiments of the present disclosure, a first body portion and a second body portion of the organizer may be bent with respect to each other, so that free ends of the false eyelashes may be lifted up to be apart from the second body portion, leaving a space under the false eyelashes. Therefore, the user may easily hold and take the false eyelashes out of the organizer.

While the present disclosure has been shown and described with reference to exemplary embodiments thereof, it will be apparent to those of ordinary skill in the art that various changes in form and detail may be made thereto without departing from the spirit and scope of the present disclosure as defined by the following claims.

DESCRIPTION OF REFERENCE NUMBERS

11, 12, 13, 14, 15, 16, 17, 18: False eyelash
21*a*, 22*a*: First body portion
21*b*, 22*b*: Second body portion
31, 32, 33, 34, 35, 36, 37, 38: Side supporting portion
41, 42, 43, 44, 45, 46, 47: Fixing portion
51, 52, 53, 54: Space
61, 62, 63: Supporting portion
61*a*, 61*b*, 62*a*, 63*a*: Side surface of supporting portion
71 72, 73, 74: Hole
81: Insertion hole
82: Separating portion
83: Mounting portion
90, 92: Protecting portion
91, 93: Protecting surface

What is claimed is:

1. An eyelash organizer, comprising:

a first body portion defining a proximal end of the eyelash organizer, the first body portion having a supporting portion forming a top surface, and a side surface extending transversely downward from the top surface;

at least one fixing portion integrated on and projecting distally outwardly from the side surface of the first body portion, the at least one fixing portion defining an upper surface, a side surface extending from the side surface of the first body portion and a bottom edge arranged at a bottom of the side surface of the fixing portion opposite the upper surface, at least one false eyelash detachably attached to the side surface of the at least one fixing portion;

a second body portion having a top surface which extends distally from a bottom edge of the side surface of the first body portion and the bottom edge of the at least one fixing portion, wherein the eyelash organizer is cut along an edge joining the bottom edge of the fixing portion and the top surface of the second body portion; and a plurality of side supporting portions integrally or separately formed with each other along an outer-most perimeter defined by the first and second body portions, wherein, the first body portion is deformable into a bent or curved state in which the upper surface of the first body portion is displaced downwardly at an incline and the at least one fixing portion is displaced upwardly at an incline to allow a bottom surface of each of the at least one fixing portion to be spaced apart from the top surface of the second body portion, creating a gap between the bottom surface of each of the at least one fixing portion and the top surface of the second body portion, and when the first body portion is bent or curved from the second body portion of the eyelash organizer, the plurality of side supporting portions are bent inward or outward to allow the first body portion to be easily bent or curved.

2. The eyelash organizer of claim 1, wherein the at least one fixing portion includes a first fixing portion and a second fixing portion, and wherein the first fixing portion and the second fixing portion abut or are spaced apart from each other on the side surface of the first body portion.

3. The eyelash organizer of claim 2, further comprising:

a protecting portion formed on the second body portion to protect the at least one false eyelash, the protecting portion having a protecting surface, wherein the protecting surface is formed to be inclined to prevent the at least one false eyelash from contacting the protecting portion; and a plurality of side supporting portions integrally or separately formed with each other along an edge of the organizer and extending in at least one of a first direction along which the supporting portion projects or a second direction opposite the first direction, wherein as the supporting portion is bent or curved from the second body portion of the eyelash organizer, the plurality of side supporting portions are bent inward or outward to allow the supporting portion to be easily bent or curved.

* * * * *